US006273504B1

(12) United States Patent
Pace et al.

(10) Patent No.: US 6,273,504 B1
(45) Date of Patent: Aug. 14, 2001

(54) PORTABLE TAILGATE PADDED SEAT

(76) Inventors: Wendel R. Pace; Miriam D. Pace, both of 115 Hwy. 90 E., Del Rio, TX (US) 78840

( * ) Notice: Subject to any disclaimer, the term of this patent is extended or adjusted under 35 U.S.C. 154(b) by 0 days.

(21) Appl. No.: 09/534,484

(22) Filed: Mar. 24, 2000

(51) Int. Cl.[7] ..... A47C 31/00

(52) U.S. Cl. ..... 297/219.1; 297/217.1; 297/DIG. 6

(58) Field of Search ..... 297/380, 219.1, 297/DIG. 6, 250.1, 217.1, 228.12, 228.13; 5/653, 420

(56) References Cited

U.S. PATENT DOCUMENTS 1,955,040 * 4/1934 Wittcoff .
2,865,433 * 12/1958 Warner .
3,603,639 * 9/1971 Wilson .
4,190,918 * 3/1980 Harvell .
4,843,662 * 7/1989 Handelman .
4,863,003 * 9/1989 Carter .
4,925,064 * 5/1990 Comora .
4,925,241 * 5/1990 Geraci .
5,205,610 * 4/1993 Reninger .
5,620,227 * 4/1997 Brune .

* cited by examiner

*Primary Examiner*—Milton Nelson, Jr.

(57) ABSTRACT

A portable tailgate padded seat for comforting the user while one sits upon the tailgate. The portable tailgate padded seat includes a pair of seat members each having a padded member securely enclosed with a cover member with the seat members being hingedly attached end-to-end; and also includes a shoulder strap being securely attached to one of the seat members; and further includes a plurality of fastening members securely attached to the seat members.

9 Claims, 2 Drawing Sheets

PORTABLE TAILGATE PADDED SEAT

BACKGROUND OF THE INVENTION

1. Field of the Invention

The present invention relates to a tailgate party pad and more particularly pertains to a new portable tailgate padded seat for comforting the user while one sits upon the tailgate.

2. Description of the Prior Art

The use of a tailgate party pad is known in the prior art. More specifically, a tailgate party pad heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,215,346; U.S. Pat. No. 4,863,003; U.S. Pat. No. 4,843,662; U.S. Pat. No. Des. 258,482; U.S. Pat. No. 4,777,681; and U.S. Pat. No. 3,336,610.

While these devices fulfill their respective, particular objectives and requirements, the aforementioned patents do not disclose a new portable tailgate padded seat. The inventive device includes a pair of seat members each having a padded member securely enclosed with a cover member with the seat members being hingedly attached end-to-end; and also includes a shoulder strap being securely attached to one of the seat members; and further includes a plurality of fastening members securely attached to the seat members.

In these respects, the portable tailgate padded seat according to the present invention substantially departs from the conventional concepts and designs of the prior art, and in so doing provides an apparatus primarily developed for the purpose of comforting the user while one sits upon the tailgate.

SUMMARY OF THE INVENTION

In view of the foregoing disadvantages inherent in the known types of tailgate party pad now present in the prior art, the present invention provides a new portable tailgate padded seat construction wherein the same can be utilized for comforting the user while one sits upon the tailgate.

The general purpose of the present invention, which will be described subsequently in greater detail, is to provide a new portable tailgate padded seat which has many of the advantages of the tailgate party pad mentioned heretofore and many novel features that result in a new portable tailgate padded seat which is not anticipated, rendered obvious, suggested, or even implied by any of the prior art tailgate party pad, either alone or in any combination thereof.

To attain this, the present invention generally comprises a pair of seat members each having a padded member securely enclosed with a cover member with the seat members being hingedly attached end-to-end; and also includes a shoulder strap being securely attached to one of the seat members; and further includes a plurality of fastening members securely attached to the seat members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable tailgate padded seat which has many of the advantages of the tailgate party pad mentioned heretofore and many novel features that result in a new portable tailgate padded seat which is not anticipated, rendered obvious, suggested, or even implied by any of the prior art tailgate party pad, either alone or in any combination thereof.

It is another object of the present invention to provide a new portable tailgate padded seat which may be easily and efficiently manufactured and marketed.

It is a further object of the present invention to provide a new portable tailgate padded seat which is of a durable and reliable construction.

An even further object of the present invention is to provide a new portable tailgate padded seat which is susceptible of a low cost of manufacture with regard to both materials and labor, and which accordingly is then susceptible of low prices of sale to the consuming public, thereby making such portable tailgate padded seat economically available to the buying public.

Still yet another object of the present invention is to provide a new portable tailgate padded seat which provides in the apparatuses and methods of the prior art some of the advantages thereof, while simultaneously overcoming some of the disadvantages normally associated therewith.

Still another object of the present invention is to provide a new portable tailgate padded seat for comforting the user while one sits upon the tailgate.

Yet another object of the present invention is to provide a new portable tailgate padded seat which includes a pair of seat members each having a padded member securely enclosed with a cover member with the seat members being hingedly attached end-to-end; and also includes a shoulder strap being securely attached to one of the seat members; and further includes a plurality of fastening members securely attached to the seat members.

Still yet another object of the present invention is to provide a new portable tailgate padded seat that is easy and convenient for the user to use on the tailgate.

Even still another object of the present invention is to provide a new portable tailgate padded seat that can be carried anywhere and can be used to cushion the tailgate to allow the user to sit comfortably upon the tailgate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
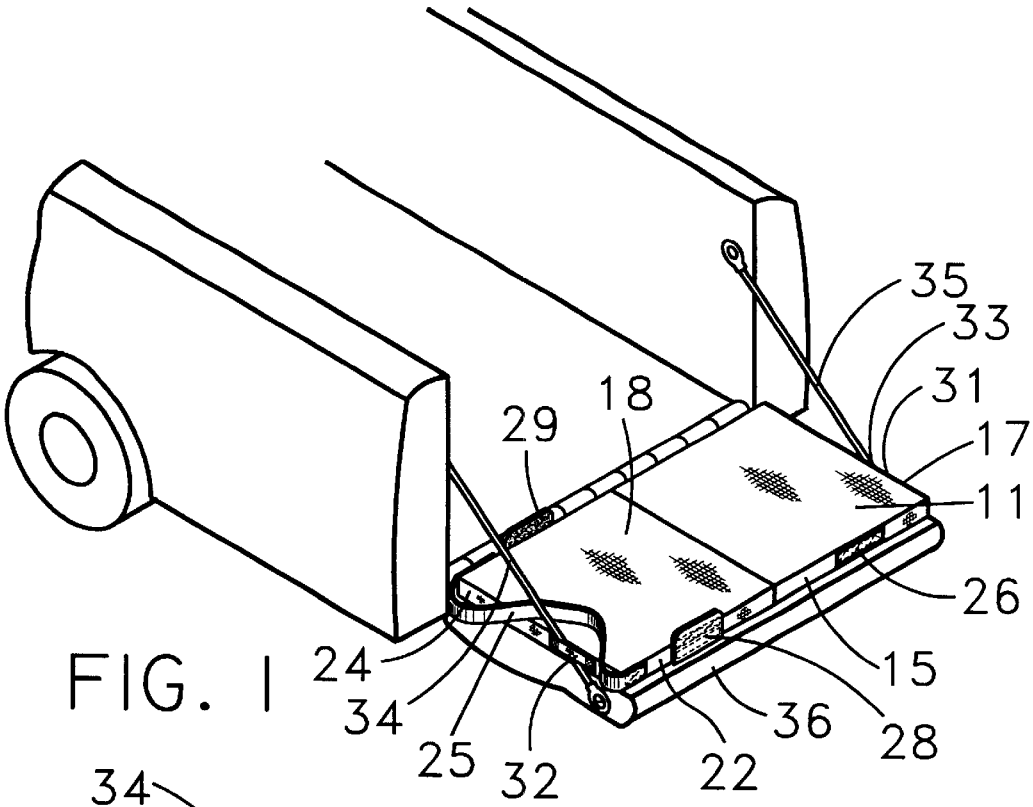
FIG. 1 is a perspective view of a new portable tailgate padded seat according to the present invention in actual use.
Figure 2:
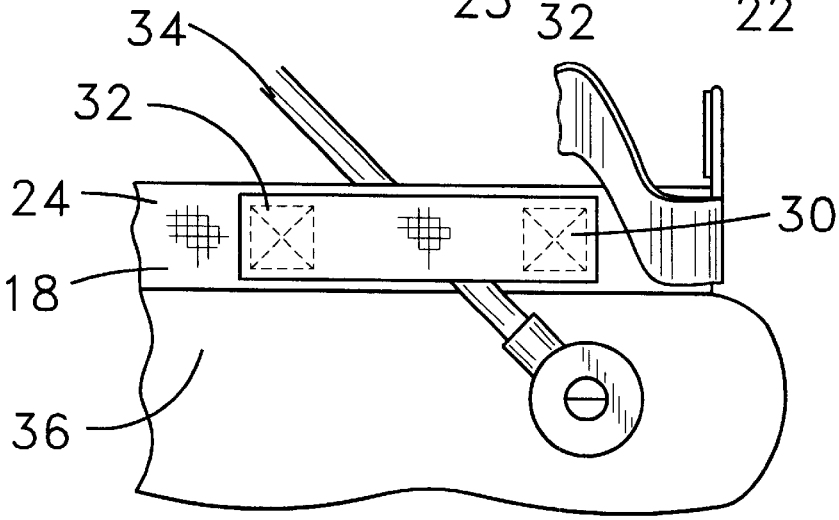
FIG. 2 is a detailed side elevational view of one of the strap members of the present invention.
Figure 3:
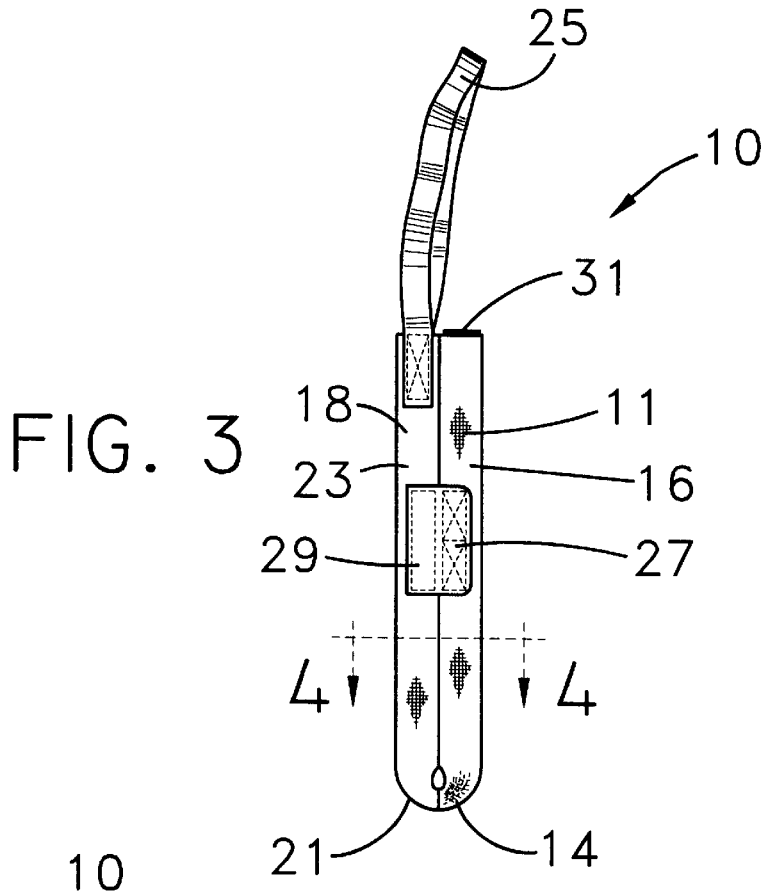
FIG. 3 is an end elevational view of the present invention in a folded position.
Figure 4:
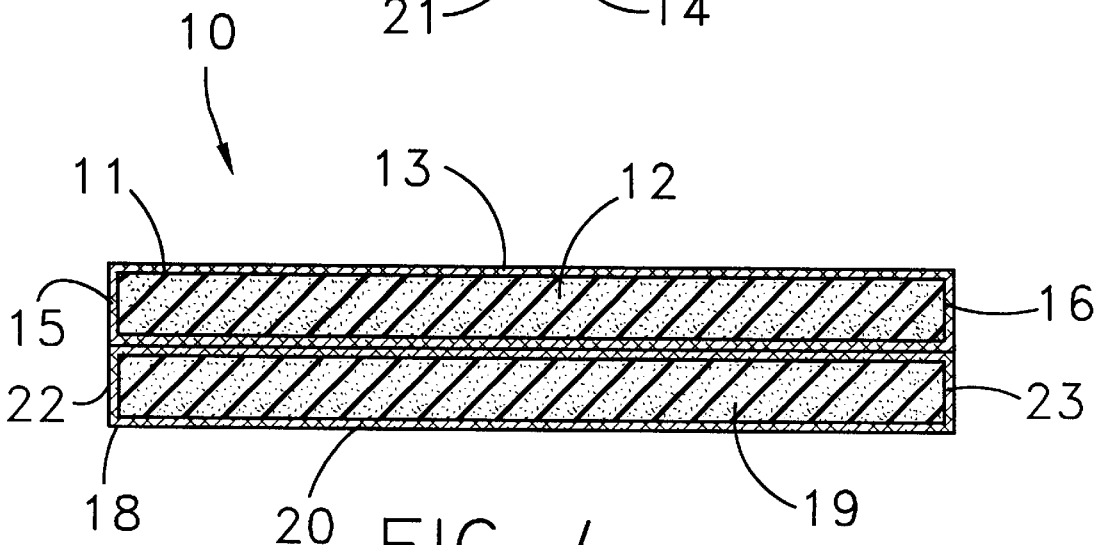
FIG. 4 is a cross sectional view of the present invention.

With reference now to the drawings, and in particular to FIGS. 1 through 4 thereof, a new portable tailgate padded seat embodying the principles and concepts of the present invention and generally designated by the reference numeral 10 will be described.

As best illustrated in FIGS. 1 through 4, the portable tailgate padded seat 10 generally comprises a pair of seat members 11,1 8 hingedly connected end-to-end. Each of the seat members 11,18 includes a padded member 12,19 and a cover member 13,20 being conventionally enclosed about the padded member 12,19. Each of the seat members 11,18 has a width, a length, a thickness, a top side, a bottom side, and ends. A first end 14 being hingedly attached to a first end 21 of the other seat member 18 with each of the seat members 11,18 being generally a quadrilateral and having a thickness of approximately 1 inch, a length of approximately 24 inches, and a width of approximately 18 inches. A shoulder strap 25 is securely attached and sewn to one of the seat members 18 for carrying the seat members 11,18. The shoulder strap 25 has ends which are securely attached to a second 22 and third 23 ends of one of the seat members 18 with the second 22 and third 23 ends being opposed to one another. A plurality of fastening members 26–33 are securely and conventionally attached to the seat members 11,18 for fastening the seat members 11,18 together in a folded position and for fastening the seat members 11,18 to a tailgate 36. The fastening members 26–33 include a first pair 26,27 of fastening members being securely and conventionally attached to the second 15 and third 16 ends of a first one 11 of the seat members. The fastening members 26–33 also includes a second pair 28,29 of fastening members securely and conventionally attached to the second 22 and third ends 23 of a second one 18 of the seat members. The fastening members 26–33 further includes a third pair 30,31 of fastening members each of which is securely and conventionally attached to a fourth one 17,24 of the ends of a respective one of the seat members 11,18. In addition, the fastening members 26–33 include a pair of strap members 32,33 each having an end securely attached and sewn to the fourth one 17,24 of the ends of a respective one of the seat members 11,18 with each of the strap members 32,33 being adapted to extend about a flexible elongate tailgate support member 34,35 and to removably fasten to a respective one of the third pair 30,31 of the fastening members for securely retaining the seat members 11,18 to the tailgate 36 with the fastening members 26–31 being essentially hook and loop fasteners.

In use, the tailgate 36 of a pickup truck, in particular, is lowered and the seat members 11,18 are positioned upon the lowered tailgate 36 and the strap members 32,33 are extended about the tailgate support members 34,35 and fastened to the third pair 30,31 of fastening members. The user can then sit comfortably upon the seat members 11,18 at tailgating parties, camping trips, beach parties, picnics and other gatherings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable tailgate padded seat system comprising:

a tailgate of a vehicle having a flexible elongate tailgate support member;

a pair of seat members hingedly connected end-to-end, each of said seat members including a padded member and a cover member being enclosed about said padded member, said seat members resting upon said tailgate of the vehicle;

a shoulder strap being securely attached to one of said seat members for carrying said seat members;

a plurality of fastening members securely attached to said seat members for fastening said seat members together in a folded position and for fastening said seat members to said tailgate;

wherein each of said seat members has a top side, a bottom side, and ends, a first said end being hingedly attached to a first said end of the other said seat member; and wherein said fastening members includes a pair of strap members each having an end securely attached to one of said ends opposite said first said end of a respective one of said seat members, said strap members extending about said flexible elongate tailgate support member of said tailgate.

2. A portable tailgate padded seat system as described in claim 1, wherein each of said seat members has a width, a length, and a thickness.

3. A portable tailgate padded seat system as described in claim 1, wherein each of said seat members is generally a quadrilateral.

4. A portable tailgate padded seat system as described in claim 1, wherein said shoulder strap has ends which are securely attached to second and third said ends of one of said seat members, said second and third ends extending from said first end of said seat member.

5. A portable tailgate padded seat system as described in claim 1, wherein said fastening members includes a first pair of said fastening members securely attached to second and third ends of a first one of said seat members, said second and third ends extending from said first end of said first seat member.

6. A portable tailgate padded seat system as described in claim 5, wherein said fastening members includes a second pair of said fastening members securely attached to second and third ends of a second one of said seat members, said second and third ends extending from said first end of said second seat member.

7. A portable tailgate padded seat system as described in claim 6, wherein said fastening members includes a third pair of said fastening members each of which is securely attached to a fourth one of said ends of a respective one of said seat members.

8. A portable tailgate padded seat system as described in claim 7, wherein each of said strap members are removably fastened to a respective one of said third pair of said fastening members for securely retain said seat members to said tailgate.

9. A portable tailgate padded seat system as described in claim 8, wherein said fastening members are hook and loop fasteners.

* * * * *